US010807615B2

(12) United States Patent
Gillis

(10) Patent No.: US 10,807,615 B2
(45) Date of Patent: Oct. 20, 2020

(54) COVERED HOPPER CAR

(71) Applicant: Gunderson LLC, Portland, OR (US)

(72) Inventor: Michael Gillis, Portland, OR (US)

(73) Assignee: Gunderson LLC, Portland, OR (US)

( * ) Notice: Subject to any disclaimer, the term of this patent is extended or adjusted under 35 U.S.C. 154(b) by 275 days.

(21) Appl. No.: 15/978,490

(22) Filed: May 14, 2018

(65) Prior Publication Data

US 2018/0334178 A1 Nov. 22, 2018

Related U.S. Application Data

(60) Provisional application No. 62/506,990, filed on May 16, 2017.

(51) Int. Cl.

| | |
|---|---|
| ***B61D 17/08*** | (2006.01) |
| ***B61D 17/12*** | (2006.01) |
| ***B61D 17/06*** | (2006.01) |
| ***B61D 7/02*** | (2006.01) |

(52) U.S. Cl.

CPC ..... *B61D 17/08* (2013.01); *B61D 7/02* (2013.01); *B61D 17/06* (2013.01); *B61D 17/12* (2013.01)

(58) Field of Classification Search

CPC ..... B61D 17/06; B61D 17/08; B61D 7/02; B61D 17/12

See application file for complete search history.

(56) References Cited

U.S. PATENT DOCUMENTS

| | | | | |
|---|---|---|---|---|
| 2,079,862 | A | 5/1937 | Kiesel, Jr. | |
| 2,092,457 | A | 9/1937 | Kiesel, Jr. | |
| 3,040,679 | A | 6/1962 | Warntz | |
| 3,399,499 | A | 9/1968 | Stetz et al. | |
| 3,490,387 | A | 1/1970 | Halcomb | |
| 3,495,548 | A | 2/1970 | Rollins | |
| 3,509,827 | A | 5/1970 | Sutter | |
| 3,515,051 | A | 6/1970 | Pulcrano | |
| 3,538,857 | A | 11/1970 | Mowatt-Larsen | |
| 3,557,713 | A | 1/1971 | Spence et al. | |
| 3,570,592 | A | 3/1971 | Rollins | |
| 3,577,932 | A * | 5/1971 | Pulcrano | B61D 7/20 105/253 |
| 3,583,330 | A | 6/1971 | Freudman | |
| 3,583,331 | A | 6/1971 | Mowatt-Larssen | |
| 3,583,564 | A | 6/1971 | Rollins | |
| 3,675,591 | A | 7/1972 | Nagy et al. | |
| 3,789,773 | A | 2/1974 | McNalley et al. | |
| 3,918,370 | A | 11/1975 | Campbell et al. | |
| 3,921,537 | A | 11/1975 | Fleshman et al. | |
| 4,003,319 | A | 1/1977 | Campbell et al. | |
| 4,168,665 | A | 9/1979 | Needham et al. | |
| 4,232,989 | A | 11/1980 | Miller | |
| 4,262,602 | A | 4/1981 | Patil et al. | |
| 4,292,898 | A | 10/1981 | Gordon et al. | |
| 4,334,481 | A | 6/1982 | Przbylinski et al. | |
| 4,352,331 | A | 10/1982 | Anderson et al. | |

(Continued)

FOREIGN PATENT DOCUMENTS

GB 204490 10/1923

*Primary Examiner* — Mark T Le

(74) *Attorney, Agent, or Firm* — Chernoff Villhauer LLP

(57) ABSTRACT

A covered hopper railroad freight car having a car body whose opposite longitudinal sides include flat, parallel, generally vertical upper side wall portions free from outwardly protruding structural strength members.

4 Claims, 4 Drawing Sheets

(56) References Cited

U.S. PATENT DOCUMENTS

| | | | | |
|---|---|---|---|---|
| 4,362,111 | A | 12/1982 | Stark et al. | |
| 4,366,757 | A | 1/1983 | Funk | |
| 4,377,058 | A | 3/1983 | Hallam et al. | |
| 4,484,528 | A | 11/1984 | Anderson et al. | |
| 4,493,266 | A | 1/1985 | Augustine, Jr. | |
| 4,497,258 | A * | 2/1985 | Ruhmann | B61D 7/02 105/248 |
| 4,498,400 | A | 2/1985 | Vorwerk et al. | |
| 4,598,646 | A | 7/1986 | Dugge et al. | |
| 4,608,931 | A | 9/1986 | Ruhmann et al. | |
| 4,630,548 | A | 12/1986 | Wiger et al. | |
| 4,696,088 | A | 9/1987 | Miller | |
| 4,741,274 | A | 5/1988 | Ferris et al. | |
| 4,875,417 | A | 10/1989 | Coulborn et al. | |
| 4,884,511 | A | 12/1989 | Hallam et al. | |
| 4,893,568 | A | 1/1990 | Adams | |
| 4,898,101 | A | 2/1990 | Harter | |
| 4,922,833 | A | 5/1990 | Coulborn et al. | |
| 4,930,427 | A | 6/1990 | Ritter et al. | |
| 4,941,411 | A | 7/1990 | Wong | |
| 4,966,081 | A | 10/1990 | Dominguez et al. | |
| 5,144,895 | A | 9/1992 | Murray | |
| 5,159,882 | A | 11/1992 | Krug et al. | |
| 5,209,166 | A | 5/1993 | Tylisz et al. | |
| 5,259,322 | A | 11/1993 | Dominguez et al. | |
| 5,263,421 | A | 11/1993 | Lichty et al. | |
| 5,367,958 | A | 11/1994 | Weiss et al. | |
| 5,390,607 | A | 2/1995 | Lydic | |
| 5,762,003 | A | 6/1998 | Downes et al. | |
| 5,860,366 | A | 1/1999 | Lydic | |
| 5,934,200 | A | 8/1999 | Lydic | |
| 6,019,049 | A | 2/2000 | Gaydos et al. | |
| 6,044,771 | A | 4/2000 | Nguyen | |
| 6,067,912 | A | 5/2000 | Miller | |
| 6,119,345 | A | 9/2000 | Lydic et al. | |
| 6,302,031 | B1 | 1/2001 | Smith et al. | |
| 6,220,502 | B1 | 4/2001 | Gallinger et al. | |
| 6,237,505 | B1 | 5/2001 | Sande et al. | |
| 6,244,191 | B1 | 6/2001 | Lydic | |
| 6,276,058 | B1 | 8/2001 | Gallinger et al. | |
| 6,279,217 | B1 | 8/2001 | Gallinger et al. | |
| 6,279,487 | B1 | 8/2001 | Gaydos et al. | |
| 6,334,397 | B1 * | 1/2002 | Valgora | B61D 7/02 105/248 |
| 6,502,518 | B1 | 1/2003 | Miller | |
| 6,604,469 | B1 | 8/2003 | Galvan et al. | |
| 8,622,004 | B2 | 1/2014 | Forbes et al. | |
| 2002/0157563 | A1 | 10/2002 | Richmond et al. | |
| 2004/0244638 | A1 | 12/2004 | Taylor | |
| 2005/0056185 | A1 | 3/2005 | Herzog et al. | |
| 2005/0056186 | A1 | 3/2005 | Creighton et al. | |
| 2008/0035014 | A1 | 2/2008 | Gillis et al. | |
| 2008/0127854 | A1 | 6/2008 | Forbes et al. | |
| 2009/0241799 | A1 | 10/2009 | Saxton et al. | |
| 2018/0127004 | A1 | 11/2018 | Gillis | |
| 2018/0334178 | A1 | 11/2018 | Gillis | |

* cited by examiner

COVERED HOPPER CAR

BACKGROUND OF THE INVENTION

The present application relates to railroad freight cars and, in particular, to a covered hopper car with increased volumetric capacity.

Covered railroad hopper car bodies have previously been constructed with flat sides reinforced by external side posts that extend laterally beyond the side sheets of the hoppers. An entire car, including such external side posts, is required not to extend into the space beyond the clearance limits for the railways on which such hopper cars are to be operated, and so the available volume of cars of that construction is limited by the space occupied by the external side posts.

Additionally, large flat panels welded to supporting beams may encounter "dimpling," slight buckling of the material, caused by weld shrinkage, which detracts from the desired appearance of a railroad freight car.

In order to provide for increased volumetric capacity other covered hopper cars have been constructed with curved sides, with longitudinal side plates that are convex on each side of the hopper car, curved about a longitudinal horizontal axis of curvature. The curvature of such side plates affords some stiffening of the car body without incorporating the weight of external side posts. Such cars, however, do include external beams, a side sill and a top chord, that are used to help provide sufficient strength and to permit convenient fabrication of such a car. While this design also provides additional volumetric capacity for such cars by comparison with cars equipped with external side posts, the curvature and the external beams result in reduced width of the hopper itself at the top of the car body and thus less than the maximum volumetric cargo capacity that could fit within the prescribed clearance window, limiting the external dimensions of the car.

What is desired, then, is an improved covered hopper car with adequate strength, yet with increased volumetric cargo capacity, while remaining within the prescribed size limitations imposed by the railroads where such a car is to be operated, and whose appearance is unaffected by distortions caused by weld shrinkage during construction of the car.

SUMMARY OF THE INVENTION

A covered hopper car as disclosed herein provides answers to some of the previously-mentioned shortcomings of previously known hopper cars.

In one embodiment, the hopper car disclosed herein includes sides having upper side sheet portions that are substantially flat.

In one embodiment of the hopper car disclosed herein, the substantially flat upper portions of the sides of such a hopper car may be supported by an internal stiffener or strengthening member.

In one embodiment of the hopper car disclosed herein, the top margin of each substantially flat side sheet may include a bend that both provides some stiffening along the top of the side portions of the hopper car and provides a member to which a roof sheet for the car can be attached.

In one embodiment of the hopper car disclosed herein, an internal side plate may extend along the length of the top margin of each of the side portions and may be oriented at an inwardly-sloped attitude, so as to bridge a space between a substantially vertical portion of a side sheet and an underside of a roof sheet of the hopper car so as to provide stiffening and support for the top margins of the side sheets.

In one embodiment of the hopper car disclosed herein longitudinally-extending corrugations may be provided to function as stiffeners at an intermediate height within the substantially flat upper portions of the sides of the hopper car, while lower portions of the sides of the hopper car may incorporate a curved configuration similar to that of previously known curved-sided hopper cars.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
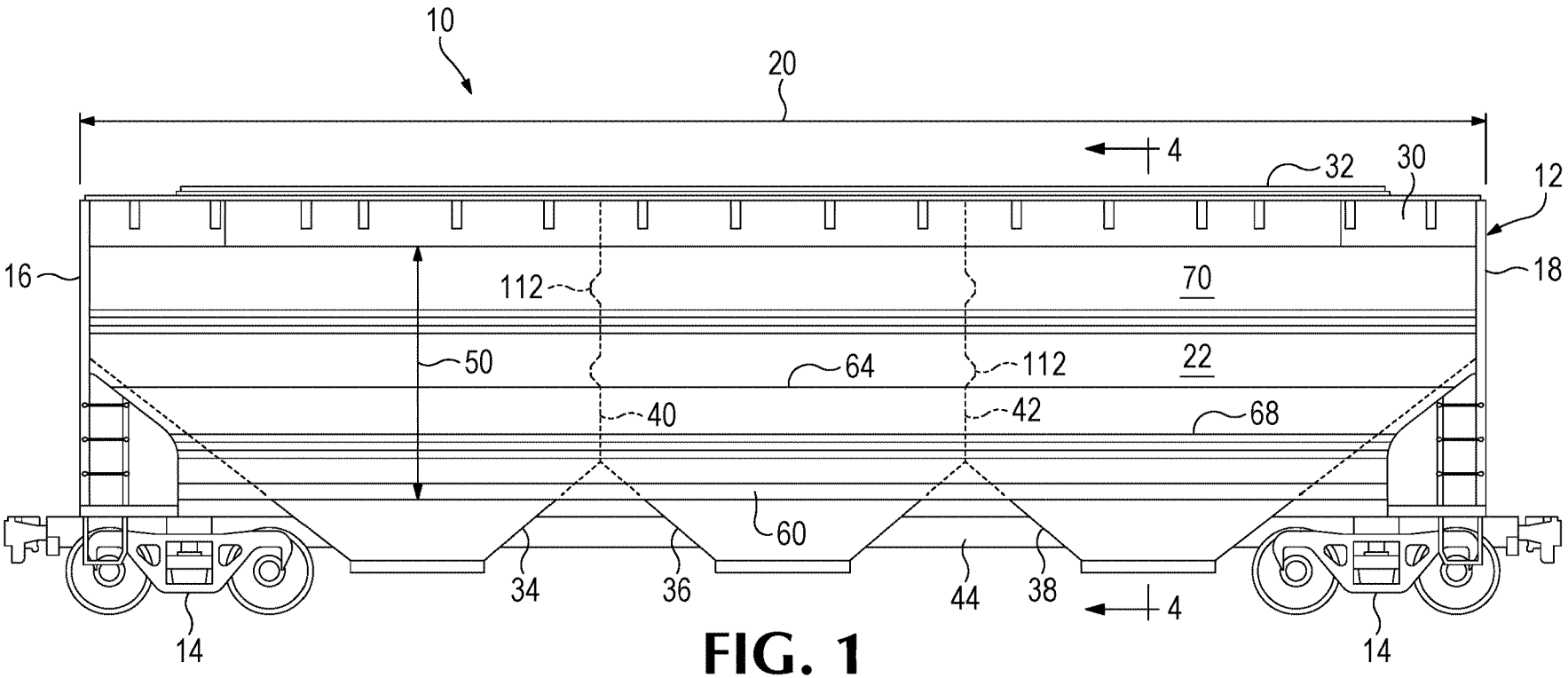
FIG. 1 is a side elevational view of a covered hopper type railroad freight car including side walls having substantially flat upper portions.
Figure 2:
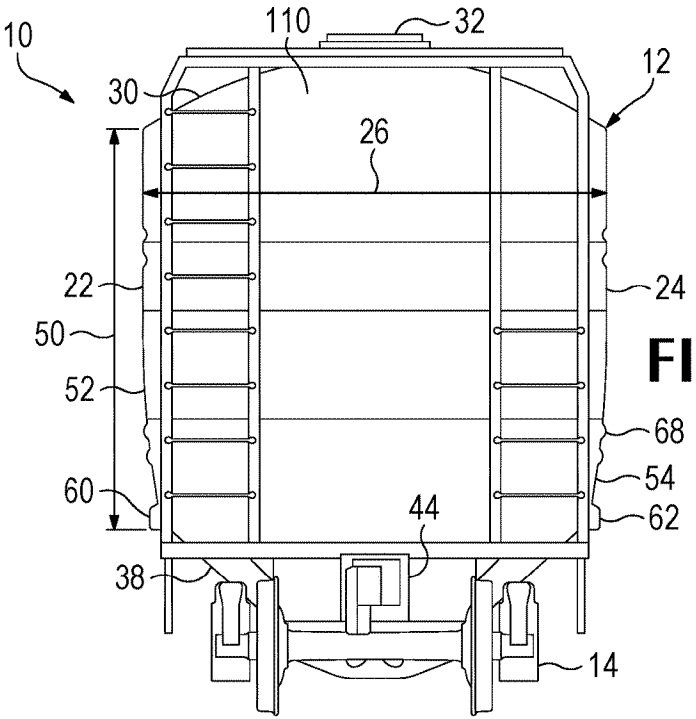
FIG. 2 is an end elevational view of the covered hopper railroad freight car shown in FIG. 1.
Figure 3:
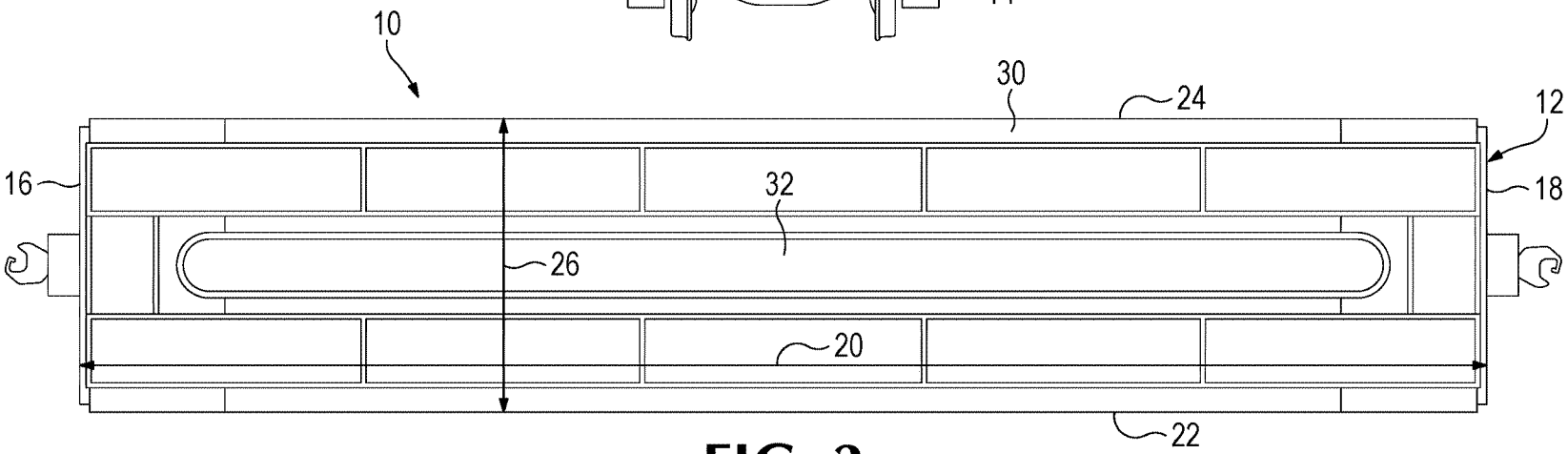
FIG. 3 is a top plan view of the covered hopper railroad freight car shown in FIGS. 1 and 2.

Referring now to the drawings that form a portion of the disclosure herein, FIGS. 1 through 3 show a railroad freight car 10 of the covered hopper type incorporating a novel construction providing an increased volumetric capacity by comparison with previously known covered hopper cars.

The covered hopper car 10 includes a car body 12 carried on a pair of wheeled trucks 14 and having a pair of opposite ends 16 and 18 defining a length 20. A pair of opposite sides 22 and 24 define a width 26. A roof 30 is attached to and supported by the ends 16 and 18 and the sides 22 and 24 and may include a centrally-located, longitudinally-extending hatch 32 providing access to, for example, three separate cargo hoppers 34, 36, and 38 defined within the car body 12.

A pair of transversely-extending bulk heads 40 and 42 extend between the sides 20 and 22, separating the cargo hoppers 34, 36, and 38 from each other.

A center sill 44 may extend through the entire length of the car body, and an appropriate protective structure 46 may extend along the top of the center sill 44 within each hopper to assure that cargo is free to slide out of each hopper, rather than being able to remain atop the center sill 44 when the hopper is emptied.

Each of the opposite sides 22 and 24 of the car body 12 has a height 50 of, for example, 112½ inches, above the hoppers and has a respective lower side portion 52, 54 that is convexly curved, with a long radius of curvature about an axis of curvature (not shown) extending longitudinally of the car body 12. The lower margin 56 of each of the lower portions 52, 54 may be joined, as by welding, to an upper margin of a respective side slope sheet of each of the hoppers 28, 30, and 32 of the car body 12. A tubular reinforcing member or bottom chord 60, 62 may extend horizontally along an outer side of each of the lower side portions 52, 54, at about the height of the upper margins 56 of the side slope sheets, on each side of the car body 12.

Upper margins 64 of the lower portions 52, 54 of the sides 22 and 24 are spaced further apart laterally with respect to the car body 12 than are the lower margins 56, and longitudinally-extending horizontal reinforcing corrugations 68 may be provided near the upper margins 64. The reinforcing corrugations 68 may be formed integrally in the metal of the lower portions 52, 54 as a part of the process of forming the lower portions of the sides 22 and 24, and may each have a width 67 of about 2¾ inches and may protrude outwardly a distance 66 of about ½ inch with respect to the lower portions of the sides, and may be separated by a distance 65 of about 2 inches. The lower portions 52 and 54 may have a height 69 of 50½ inches, and may be of sheet steel of about 7 gauge thickness, for example.

Joined to the upper margins 64 of the lower portions 52, 54 of the sides 20 and 22, as by appropriate weld joints, are respective substantially planar upper side wall portions 70 and 72 of the sides 20 and 22, extending substantially vertically upward and parallel with each other, over a height 74 of 62 inches, for example, that is greater than the height 69. The upper side wall portions 70 and 72 may be of sheet steel having a thickness 74 of about 7 gauge for example. The upper side wall portions of the car body 12 may be spaced apart from each other by an appropriate distance resulting in the overall width 26 of the car 10 approaching, but not exceeding, the maximum width permitted by the applicable clearance window associated with the railroad track lines over which the car 10 may be expected to be operated. Since the upper sidewall portions 70 and 72 of the sides 20 and 22 are generally planar, vertical, and parallel with each other a maximum amount of cargo space can be provided between them, while the car body overall is not too wide to remain within the clearance envelope appropriate for the hopper car 10. The absence of support posts on the exterior faces of the side walls of the covered hopper car 10 leaves a long, generally flat, exterior shape for the sides 20 and 22 of the hopper car body 12, with few or no dimples caused by weld shrinkage to deteriorate from the generally pleasing appearance of the hopper car body 12.

As may be seen best in FIG. 3, the roof 30 covers the entire hopper car body includes the centrally-located, longitudinally-extending hatch 32 for receiving bulk cargo such as grain, and a hatch cover of appropriate design may also be provided.

Figure 4:
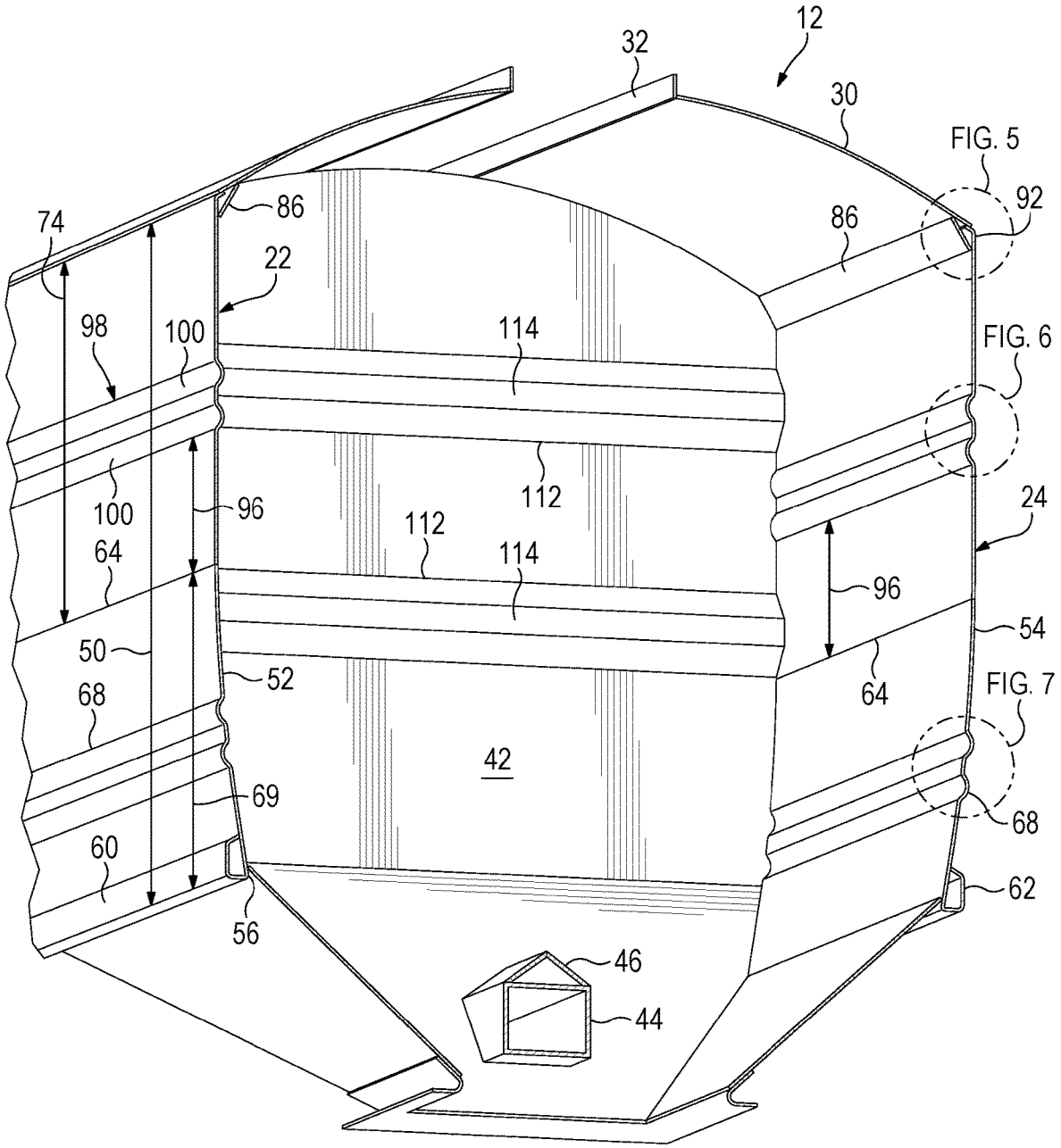
FIG. 4 is an isometric view, taken along line 4-4 of FIG. 1, at an enlarged scale, showing a portion of the car body including the structure of the sidewalls, a bulkhead, and past of a hopper included in the car body, as well as the manner of interconnection of the side walls with the roof of the car body.
Figure 5:
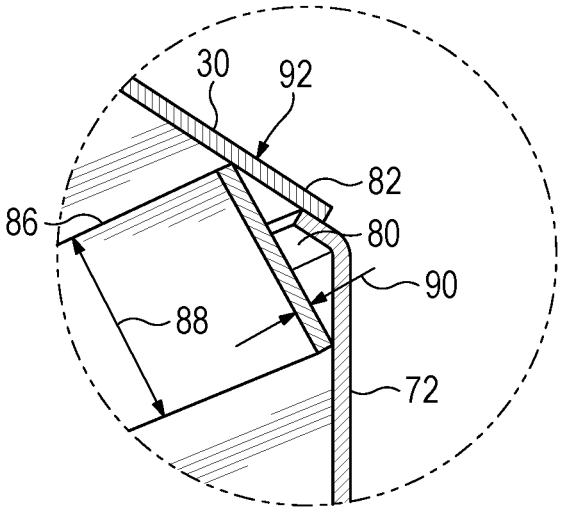
FIG. 5 is a detail view, showing a portion of FIG. 4 at an enlarged scale, including the interconnection of a side wall with the roof and the configuration of a stiffening portion of the side wall member of the car body.

As shown in FIGS. 4 and 5, a narrow portion of each upper side wall portion 70 and 72 may be bent inward along a horizontal line to provide an inwardly and upwardly inclined flange portion 80. A lower, laterally outward margin 82 of a base sheet of the upwardly arched roof 30 of the car body 12 may overlap the flange by a small distance, such as about one-half inch. The outward margin 82 of the roof is securely attached to the flange portion 80, as by welding. Additionally, a reinforcing side plate 86, having a width 88 of 4¾ inches, for example, and which may be of sheet metal material whose thickness 90 is about 0.18 inch (7 gauge), for example, thus of similar thickness to the side wall portions 70 and 72 and the base sheet of the roof 30, forming a triangular tubular top chord structure 92 extending along the junction between the upper side wall flange portions 80 and the roof 30.

Figure 6:
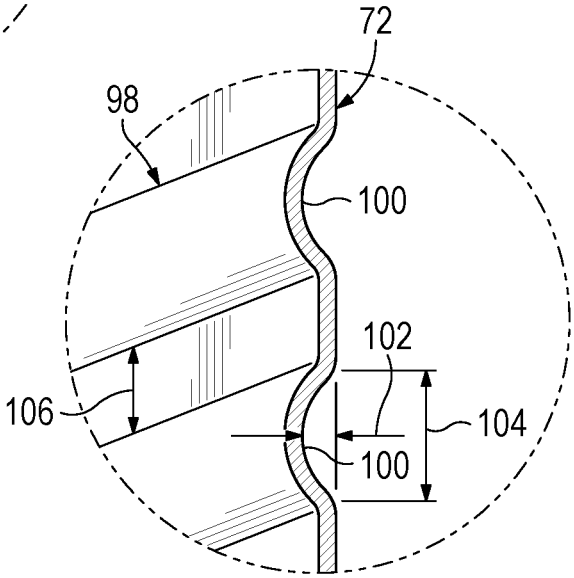
FIG. 6 is a detail view, showing a portion of FIG. 4 at an enlarged scale, including a stiffener portion of a lower part of a side wall member of the car body.
Figure 7:
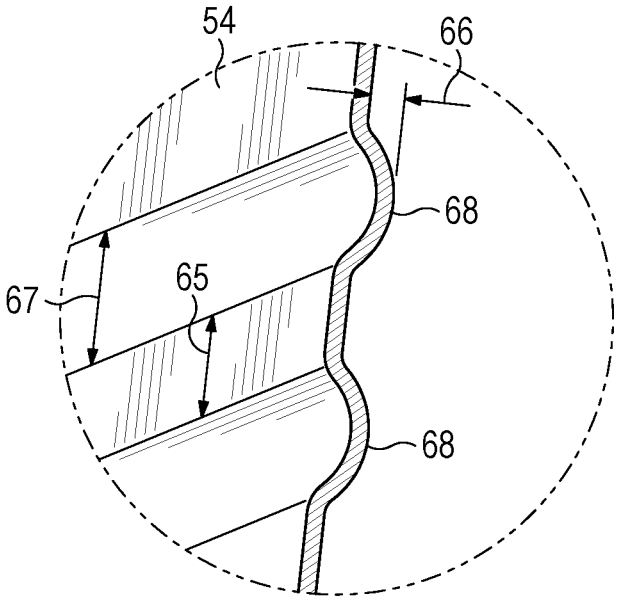
FIG. 7 is a detail view, showing a portion of FIG. 4 at an enlarged scale, including a stiffener portion of a bulkhead extending between the side walls of the car and dividing it into separate hopper portions.

At a distance 96 of, for example, 22¼ inches above the joints between the upper margin 64 of the lower portions 52, 54 and the lower margins of the upper side wall portions 70 and 72, a longitudinally-extending stiffener 98 may be provided in each of the upper side wall portions. The stiffener 98 may have the form of, for example, a pair of parallel channels 100 that may be formed, as by rolling, in the metal plate material of each of the upper side wall portions 70 and 72. As may be seen in greater detail in FIG. 6, the channels 100 may each have a depth of 102 of 1 1/16 inch and a width 104 of 5 inches measured in a vertical direction along the upper side wall portion 70 or 72, and the channels 100 may be spaced apart from each other by a distance 106 of about 2 inches. While the stiffener 98 might be formed as a separate piece that could be welded into place between respective upper and lower panels (not shown) of the upper sidewall portions, it is expected that the stiffener 98 will be formed in the sheet metal of each upper side wall portion 70 or 72 as by rolling the metal plate material prior to cutting it to its final shape for use as an upper side wall portion 70 or 72 of the car body 12. The channels 100 may be formed so that they protrude inwardly, rather than bulging outwardly beyond the plane of the upper side wall portions 70 and 72.

At each of the ends 16 and 18 a substantially vertical and generally flat end plate 110 extends upward from the respective slope sheet of the cargo hopper 34 or 38 defined by that end of the car body 12. Each end plate 110 is securely attached, as by welding, to the inner side of each of the adjacent upper side wall portions 70 and 72 and to the underside of the roof 30, to complete a closed end of the respective cargo hopper 34 or 38.

At respective positions along the length of the car body 12 the bulkheads 40 and 42 extend upward, from the upper margins of the slope sheets of the hoppers to the roof 30. Each bulkhead 40 or 42 extends transversely of the car body 12 and is securely attached, as by being welded, to the hopper slope sheets and the interior side of each of the lower side portions 52 and 54, the upper side wall portions 70 and 72, and the roof 30. Rather than being merely a flat plate, each bulkhead 40 and 42 may be stiffened by at least one transversely-extending horizontal stiffener 112. Such a stiffener may be of a conventional trapezoidal shape such as incorporating a pair of sloped portions each connected to an offset portion 114 extending vertically, parallel with, but longitudinally spaced a small distance apart from the main plane of the particular bulkhead, as may be seen best in FIG. 1. It will be appreciated that the bulkhead stiffeners 112 may be of other designs, such as including curved corrugations, so long as they provide appropriate rigidity of the bulkheads 40 and 42 and provide some support for the flat, vertical, upper side wall portions 70 and 72.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A car body for a covered hopper railroad freight car, the car body comprising: a pair of opposite sides and a pair of opposite ends defining a width, a height, and a length, the car body including a plurality of cargo hoppers between the opposite sides, and each of the opposite sides extending over a majority of a height of the car body and including a generally vertical upper side wall portion, an upper margin of each of the upper side wall portions bent inwardly to provide an inwardly and upwardly inclined flange portion, the car body additionally including a roof extending along the length and extending transversely from one to the other of the opposite sides, a lower, laterally outward margin of the roof overlaps with the flange portion and being securely attached to the flange portion, and the car body further including an internal plate extending longitudinally along the car body and being oriented diagonally with an upper portion of one of the upper side wall portions and diagonally with a member of the roof, thereby interconnecting the upper side wall portion and the roof and forming a top chord, the internal plate being distinct from the upper side wall portions and from the member of the roof, and upper and lower edges of the internal plate being attached to the roof and the upper side wall portions, respectively.

2. The car body of claim 1 wherein each of the upper side wall portions is of sheet metal and includes a longitudinally extending stiffener member formed therein.

3. The car body of claim 1 wherein the opposite sides include convexly curved lower side portions and each lower side portion includes a bottom chord protruding laterally outward and extending along a bottom margin of each lower side portion.

4. The car body of claim 3 wherein each of the lower side portions is of plate metal and includes a longitudinally extending stiffener portion formed therein.

* * * * *